United States Patent [19]
Magid et al.
[11] 4,318,244
[45] Mar. 9, 1982

[54] INFLATABLE THROWING TOY

[76] Inventors: Sidney H. Magid, 4th Fl., No. 10, Alley 5, Lane 12, Sec. 4, Jen Ai Rd.; Wang C. Chung, 3, 11th Fl., No. 311, Sec. 4, Chung-Hsiao East Rd., both of Taipei, Taiwan

[21] Appl. No.: 156,112

[22] Filed: Jun. 3, 1980

[51] Int. Cl.[3] ..... A63H 27/00
[52] U.S. Cl. ..... 46/74 D; 46/89
[58] Field of Search ..... 46/74 D, 87, 88, 89, 46/179, 178, 174, 52; 273/424, 425; 9/11 A, 2 A

[56] References Cited

U.S. PATENT DOCUMENTS

| | | | |
|---|---|---|---|
| 3,130,406 | 4/1964 | Jones-Hinton et al. | 9/11 A X |
| 3,180,639 | 4/1965 | Cotler et al. | 46/89 X |
| 3,900,986 | 8/1975 | Torres | 46/74 D |
| 4,135,325 | 1/1979 | Lehman | 46/74 D |
| 4,143,483 | 3/1979 | Kifferstein et al. | 46/74 D |

FOREIGN PATENT DOCUMENTS

| | | | |
|---|---|---|---|
| 1603662 | 6/1971 | France | 46/74 D |

*Primary Examiner*—Paul J. Hirsch
*Assistant Examiner*—Mickey Yu
*Attorney, Agent, or Firm*—McAulay, Fields, Fisher, Goldstein & Nissen

[57] ABSTRACT

An inflatable throwing toy made of air impervious sheet material comprises an inflatable outer ring having an inflating valve located thereon, a first disc section which is an extension of the wall of the bottom side of the outer ring, a second disc section opposite to the first disc section which is an extension of the other side of the outer ring, and a third disc section extending from the top side of the outer ring and having an inflating valve provided thereon. The first disc section and the second disc section of the inflatable throwing toy are separated from each other within the internal periphery of the inflatable throwing toy by a cylindrical gusset section. The inflatable throwing toy may further comprise a plurality of air activated envelopes attached on the first disc section having air activated noise makers located therein.

3 Claims, 4 Drawing Figures

INFLATABLE THROWING TOY

BACKGROUND OF THE INVENTION

1. Field of the Invention

The present invention relates to an inflatable throwing toy.

2. Brief Description of the Prior Art

Conventional toy throwing discs are made of hard plastics materials and are shaped as flat discs having a concave flange on their peripheral edges. The discs are thrown into the air by players and caught by other players after they float in the air for a long distance. These conventional toys are not safe for young children because they can cause injury to the children due to their hardness and speed.

BRIEF SUMMARY OF THE PRESENT INVENTION

It is therefore the main object of the present invention to provide a disc shape inflatable throwing toy which can be thrown and caught by the players with controlled floating movement.

Another object of the present invention is to provide an inflatable throwing toy having sound making devices located thereon which will generate a certain sound by the activation of the air when the inflatable throwing toy is flying in the air.

An important feature of the present invention is that the toy consists of an inflatable outer ring having a plurality of sheet sections extending within said outer ring constituting the whole toy.

Accordingly, the inflatable throwing toy of the present invention comprises an inflatable outer ring having an inflating valve located thereon, a first disc section which is an extension of the wall of the bottom side of the outer ring, a second disc section opposite to said first disc section which is an extension of the other side of the outer ring, and a third disc section extending from the top side of the outer ring having an inflating valve located thereon. The first disc section and the second disc section are separated from each other within the internal periphery of the inflatable throwing toy by a cylindrical gusset section. The inflatable throwing toy may further comprise a plurality of air activated envelopes located on the first disc section with air activated noise makers located therein.

BRIEF DESCRIPTION OF THE DRAWINGS

Those and other objects, features and advantages of the present invention will become apparent from the following detailed description of the preferred embodiment with reference to the accompanying drawings, wherein.

DETAILED DESCRIPTION OF THE PREFERRED EMBODIMENTS

Figure 1:
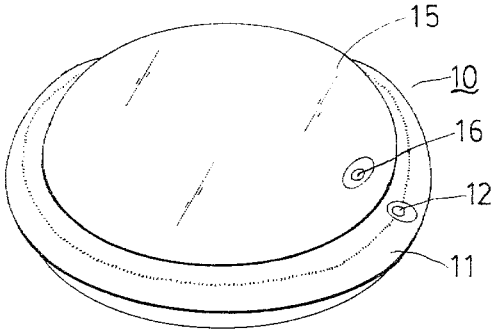
FIG. 1 is a perspective view of the inflatable throwing toy according to the present invention.
Figure 2:
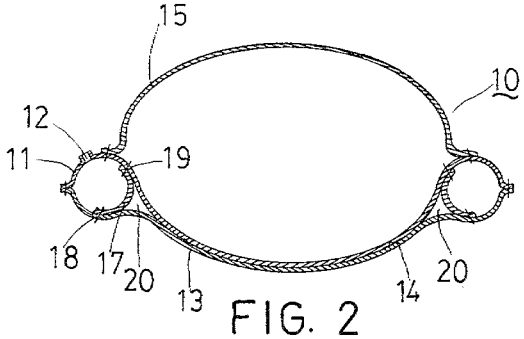
FIG. 2 is a sectional view of the inflatable throwing toy according to the present invention.

Referring to FIGS. 1 and 2 which show the perspective and sectional view of an embodiment of the inflatable throwing toy according to the present invention, the toy 10 comprises an outer ring 11 having an inflating valve 12 located thereon for inflating the same, a first disc section 13 which is an extension of the wall of the bottom side of the outer ring 11, a second disc section 14 opposite to said first disc section 13 which is an extension of the wall of the other side of the outer ring 11, and a third disc section 15 extending from the toy side of the outer ring 11 with an inflating valve 16 located therein. The outer ring 11, the extending first disc section 13 and the second disc section 14 are made of soft plastics materials. The third disc section 15 is also made of soft plastics material. There is a gusset section 17 substantially in a cylindrical shape heat sealed with the first disc section 13 and the second disc section 14 at position 18 and 19 forming part of the outer ring 11. Since there is a limited amount of air present in the region 20 between the first disc section 13 and the second disc section 14, a suction effect will be produced to cause the first disc section 13 to become inwardly curved near the outer ring 11 when the inflatable throwing toy is inflated. The players will grasp the inflatable throwing toy and throw it with a spinning motion into the air. The toy will spin and float in the air for a long distance with a controlled movement.

Figure 3:
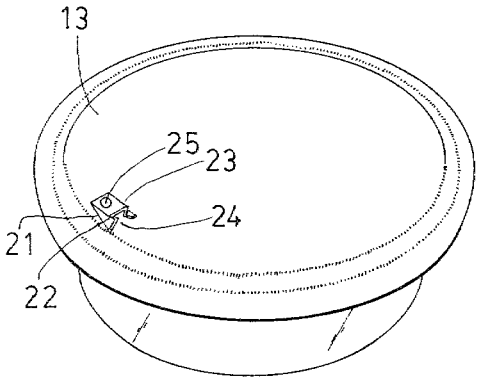
FIG. 3 is a partly broken perspective view of the inflatable throwing toy according to the present invention showing the air activated envelope.

Referring to FIG. 3 which shows a partly broken perspective view of the inflatable throwing toy of the present invention with an air activated envelope, the air activated envelope 21 is attached to the bottom of the first disc section 13. The envelope 21 comprises at least one bellows wall 22 or 23 heat sealed to the section 13 forming an opening slit 24, and an air activated noise maker 25 being installed at the end portion of the envelope 21. When the inflatable throwing toy 10 is flying in the air, air will pass and activate the noise maker 25 through the opening slit 24 and a certain kind of sound may be produced during the flying of the inflatable throwing toy.

Figure 4:
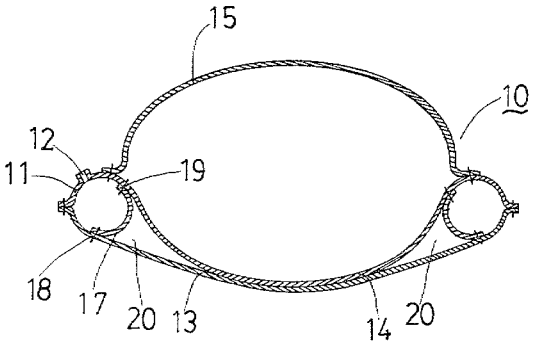
FIG. 4 is a sectional view of another embodiment of the inflatable throwing toy according to the present invention showing a flat first disc section without any curvature.

Referring to FIG. 4 which shows another embodiment of the inflatable throwing toy of the present invention, there is sufficient amount of air present in the region 20 between the first disc section 13 and the second disc section 14 to cause a smooth section 13 without any inward curvature.

Although the present invention has been described hereinbefore by way of a preferred embodiment, it should be understood that various changes or modifications are still possible by those skilled in the art without departing from the spirit and scope of the present invention.

What is claimed is:

1. An inflatable toy made of air impervious sheet material comprising an inflatable outer ring having an inflating valve located thereon, said outer ring having a top wall side and a bottom wall side interconnected by a cylindrical gusset section; a first disc section which is an extension of the wall of the bottom side of said outer ring; a second disc section opposite to said first disc section which is an extension of the wall of the top side of said outer ring; and a third disc section extending from the top side of said outer ring and having an inflating valve thereon; said first and secod disc sections maintained in close proximity with each other separated only by the thickness of said gusset section; whereby, when the toy is inflated, said first disc section will form an inward curve at the inner side of the bottom of said outer ring.

2. An inflatable toy as claimed in claim 1 further comprising a plurality of air activated expandable envelopes attached to the first disc section having air activated noise makers provided therein.

3. An inflatable toy as claimed in claim 1 further comprising a plurality of air activated expandable envelopes attached to the third disc section having air activated noise makers provided therein.

* * * * *